US008052479B1

(12) United States Patent
Zhu

(10) Patent No.: US 8,052,479 B1
(45) Date of Patent: Nov. 8, 2011

(54) ELELCTRICAL CONNECTOR PLUG AND RECEPTACLE MATING WITH THE PLUG

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/890,715

(22) Filed: Sep. 27, 2010

(30) Foreign Application Priority Data

Apr. 26, 2010 (CN) ..... 2010 2 0170254

(51) Int. Cl.
*H01R 24/00* (2011.01)

(52) U.S. Cl. ..... 439/660

(58) Field of Classification Search ..... 439/540.1, 439/660, 680
See application file for complete search history.

(56) References Cited

U.S. PATENT DOCUMENTS 6,589,074 B1 * 7/2003 Wu ..... 439/540.1
6,699,049 B1 * 3/2004 Wu ..... 439/79
6,743,060 B2 * 6/2004 Wu ..... 439/660
6,767,235 B2 * 7/2004 Wu ..... 439/328
7,393,247 B1 * 7/2008 Yu et al. ..... 439/638
7,682,190 B2 * 3/2010 Huang et al. ..... 439/660
7,726,983 B2 6/2010 Zhu
2005/0048846 A1 * 3/2005 Suzuki et al. ..... 439/660

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

An electrical connector plug includes a plug housing and a plurality of first contacts received in the plug housing. The plug housing defines a plug base and a pair of L-shaped tongues perpendicularly extending from the plug base. Each L-shaped tongue includes a main board and a side board perpendicular with the main board. Each first contact includes a first contacting portion exposing to a first face of the main board, a first terminal portion and a first retaining portion connecting the first contacting portion and the first terminal portion. The electrical connector plug further includes at least a pair of second plug contacts respectively secured to an outside face of the side board away from the main board and perpendicular with the first face of the main board.

19 Claims, 4 Drawing Sheets

ELELCTRICAL CONNECTOR PLUG AND RECEPTACLE MATING WITH THE PLUG

BACKGROUND OF THE INVENTION

1. Field of the Invention

The present invention relates to an electrical connector plug and receptacle mating with the plug.

2. Description of the Related Art

U.S. Pat. No. 7,726,983 issued to Yu Zhu on Jun. 1, 2010 disclosed a conventional SATA (Serial Advanced Technology Attachment) plug. The SATA plug comprises an insulative housing and a plurality of contacts secured in the insulative housing. The insulative housing defines a pair of L-shaped tongues. Seven contacts are received in a shorter tongue and constituted of three ground contacts and four differential signal contacts. The longer tongue receives a plurality of power contacts. The electrical arrangement has more and more complicated function, thus the conventional SATA plug might not meet requirement by the limitation of the number of the contacts.

In view of the above, a new electrical connector plug and receptacle mating with the plug that overcome the above-mentioned disadvantages are desired.

SUMMARY OF THE INVENTION

Accordingly, an object of the present invention is to provide an electrical connector plug and receptacle mating with the plug which can have more function.

To fulfill the above-mentioned object, an electrical connector plug includes a plug housing and a plurality of first contacts received in the plug housing. The plug housing defines a plug base and a pair of L-shaped tongues perpendicularly extending from the plug base. Each L-shaped tongue includes a main board and a side board perpendicular with the main board. Each first contact includes a first contacting portion exposing to a first face of the main board, a first terminal portion and a first retaining portion connecting the first contacting portion and the first terminal portion. The electrical connector plug further includes at least a pair of second plug contacts respectively secured to an outside face of the side board away from the main board and perpendicular with the first face of the main board.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
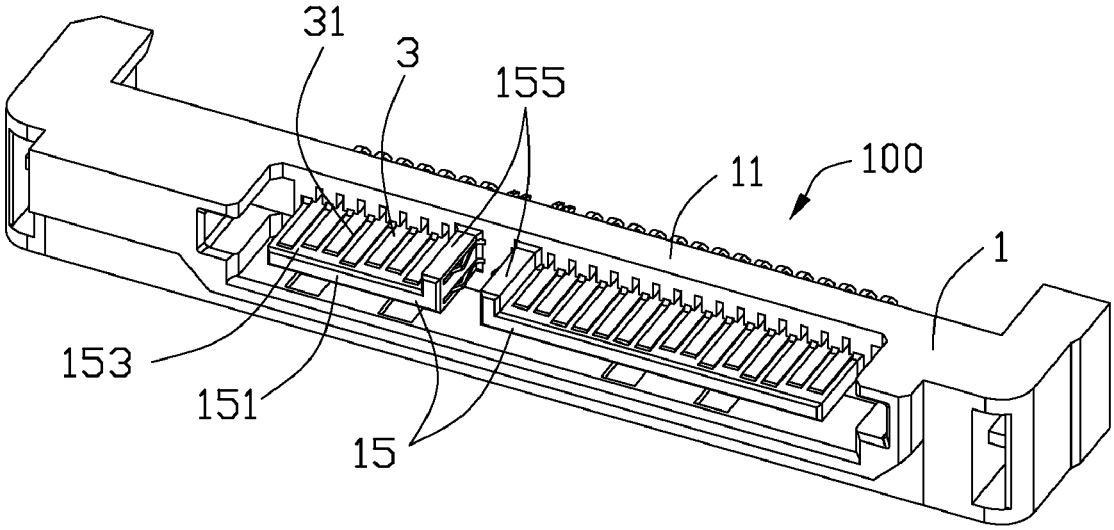
FIG. 1 is a perspective view of an electrical connector plug of the present invention.
Figure 2:
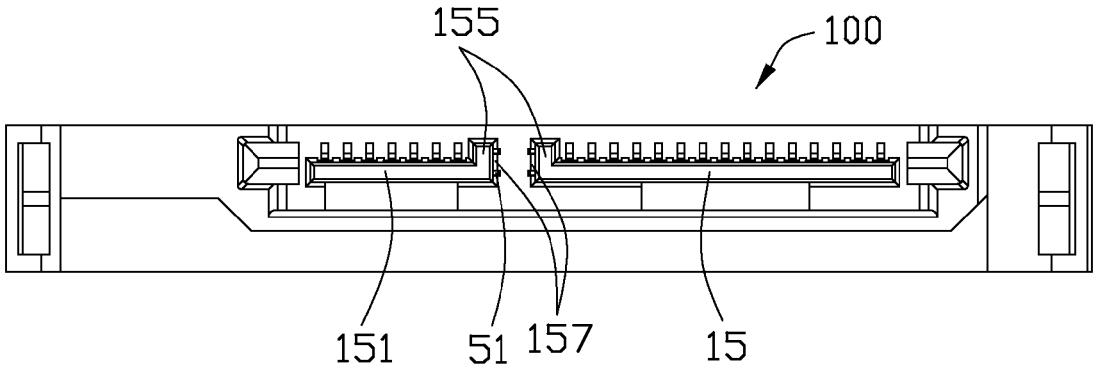
FIG. 2 is a front view of the electrical connector plug of FIG. 1.
Figure 3:
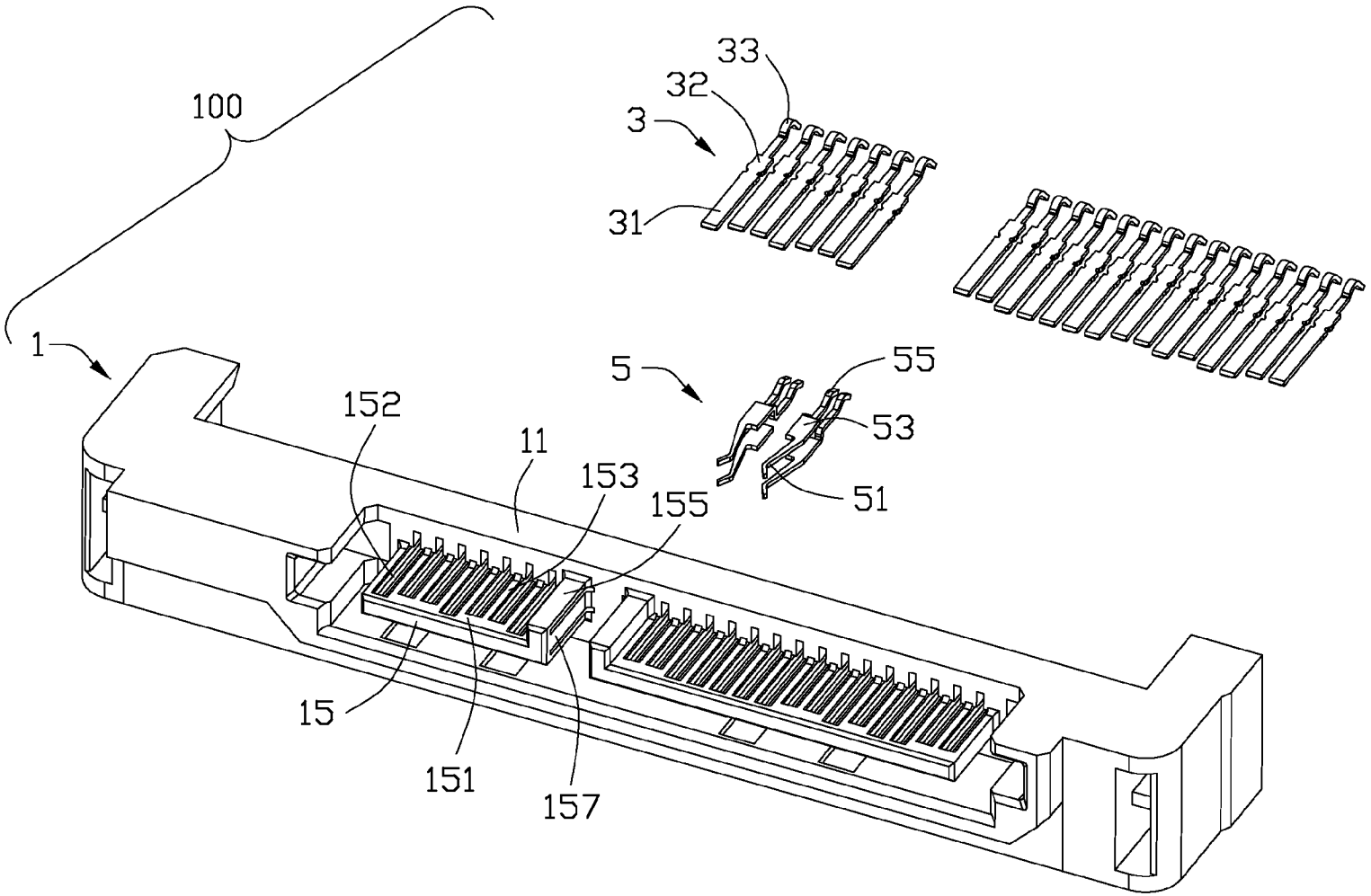
FIG. 3 is an exploded view of the electrical connector plug of FIG. 1.

Referring to FIGS. 1-3, an electrical connector plug 100 comprises a plug housing 1 and a plurality of first plug contacts 3 received in the plug housing 1.

The plug housing 1 comprises a plug base portion 11 and a pair of side by side L-shaped tongues 15 perpendicularly protruding from the plug base portion 11. Each L-shaped tongue 15 includes a main board 151 and a side board 155 perpendicular with the main board 151. The two side boards 155 are adjacent with each other.

The plug housing 1 defines a plurality of receiving passageways 152 receiving the first plug contacts 3. Each first plug contact 3 comprises a first contacting portion 31 received in the receiving passageway 152 and exposing to a first face 153 of the main board 151, a first retaining portion 32 fixed to the receiving passageway 152 and a first terminal portion 33 extending out of the plug housing 1. The first contacting portions 31 are configured with board shaped. The first terminal portions 33 are configured with arc-shaped and elastically resisting on or welding to a print circuit board (not shown).

The electrical connector plug 100 further comprises two pairs of second plug contacts 5 fixed to outside faces 157 of the side boards 155 away from the main boards 151 and perpendicular with the first faces 153 of the main boards 151. Each second plug contact 5 comprises a second contacting portion 51, a second retaining portion 53 and a second terminal portion 55 extending one by one. The second contacting portions 51 protrude out of outside faces 157 of the side boards 155 and away from the main boards 151. The second retaining portions 53 are board shaped and wider than the other structures of the second plug contact 5. The second terminal portions 55 are configured with arc-shaped and elastically resisting on or welding to the print circuit board. The second plug contacts 5 fixed to one L-shaped tongue 5 are arranged in an up-to-down direction perpendicular with the first face 153 of the L-shaped tongue 5 and the terminal portions 55 are in the same plane. The second plug contacts 5 are formed by stamping and the second contacting portions 51 are planar with the second retaining portion 53 to simplify the manufacturing process of the second plug contacts 5. The second plug contacts 5 fixed to one L-shaped tongue 51 configure a pair of differential signal. The electrical connector plug includes more contacts relative to a conventional electrical connector plug to expand the function and is compatible with the conventional electrical connector plug simultaneously.

Figure 4:
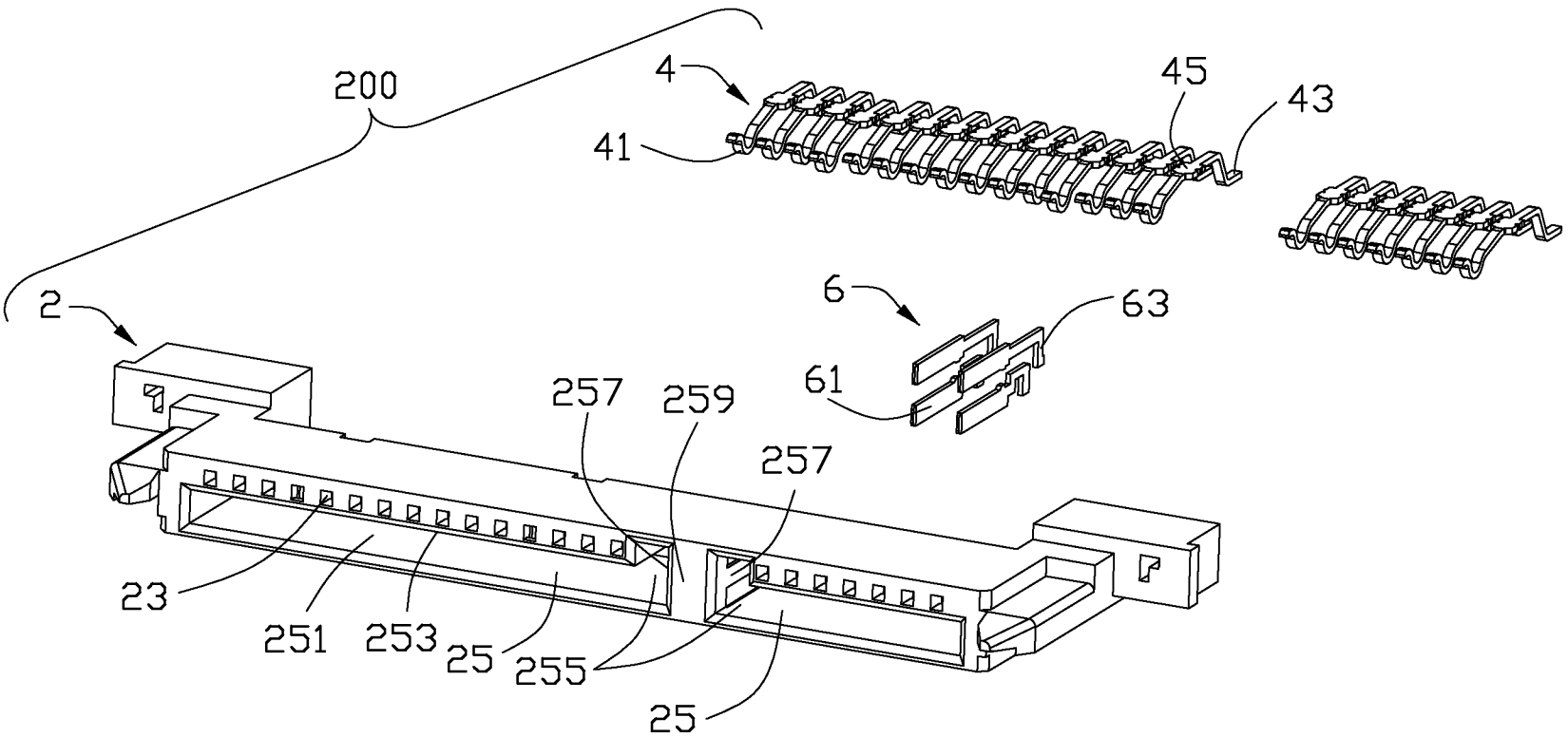
FIG. 4 is a perspective view of an electrical connector receptacle mating with the electrical connector plug of the FIG. 1.

Referring to FIG. 4 showing an electrical connector receptacle 200 mating with the electrical connector plug 100, the electrical connector receptacle 200 comprises a receptacle housing 2 and a plurality of first receptacle contacts 4 received in the receptacle housing 2. The receptacle housing 2 defines a pair of L-shaped openings 25 and a plurality of second receiving passageways 23. The two L-shaped openings 25 are separated with a partition board 259. Each L-shaped opening 25 defines a main opening 251 and a side opening 255 perpendicular with the main opening 251. The second receiving passageways 23 are arranged in a lengthwise direction perpendicular with the up-to-down direction and communicate with the L-shaped opening 25.

The first receptacle contacts 4 are received in the second receiving passageways 23. Each first receptacle contact 4 comprises a third contacting portion 41 exposing to a second face 253 of the main opening 25, a third terminal portion 43 and a third retaining portion 45 bridging the third contacting portion 41 and the third terminal portion 45. The third retaining portions 45 are secured to the second receiving passageways 23 by barbs at the opposite sides thereof. The third terminal portions 43 extend out of the receptacle housing 2 and are welded to the print circuit board.

The electrical connector receptacle 200 further comprises two pairs of second receptacle contacts 6 secured to two opposite sides of the partition wall 259, i.e., inner faces 257 of the side openings 255 away from the main openings 251 and perpendicular with the second faces 253 of the main openings 251. Each second receptacle contact 6 comprises a fourth contacting portion 61 of board shaped and a fourth terminal portion 63 extending from the fourth contacting potion 61 and planar with the fourth contacting portion 61. The second receptacle contacts 6 are formed by stamping. The second receptacle contacts 6 received in one L-shaped opening 25 are planar with each other to simplify the manufacturing process of the second receptacle contacts. The second receptacle contacts 6 received in one L-shaped opening 25 have the same shape with each other except for the fourth terminal portions 63.

When the electrical connector plug 100 is inserted into the electrical connector receptacle 200, the first contacting portions 31 of the first plug contacts 3 contact with the third contacting portions 41 of the first receptacle contacts 4 and the second contacting portions 51 of the second plug contacts 5 contact with the fourth contacting portions 61 of the second receptacle contacts 6. Thus, the electrical connector plug 100 and receptacle 200 can transmit more signal by more contacts than the conventional electrical connector plug and receptacle to expand the function.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector plug, comprising:

a plug housing defining a plug base and a pair of L-shaped tongues perpendicularly extending from the plug base, each L-shaped tongue comprising a main board and a side board perpendicular with the main board;

a plurality of first contacts received in the main boards, each first contact comprising a first contacting portion exposing to a first face of the main board, a first terminal portion and a first retaining portion connecting the first contacting portion and the first terminal portion; wherein the electrical connector plug further comprises at least a pair of second plug contacts respectively secured to an outside face of the side board away from the main board and perpendicular with the first face of the main board.

2. The electrical connector plug as claimed in claim 1, wherein each second plug contact comprises a second contacting portion of arc-shaped, a second terminal portion of arc-shaped and a second retaining portion bridging the second contacting portion and the second terminal portion.

3. The electrical connector plug as claimed in claim 2, wherein the second contacting portions are planar with the second retaining portions and parallel with the main boards of the L-shaped tongues.

4. The electrical connector plug as claimed in claim 3, wherein the second retaining portions are configured with board shaped and wider than the other structures of the second plug contacts.

5. The electrical connector plug as claimed in claim 4, wherein the second plug contacts received in one L-shaped tongue are parallel with each other in an up-to-down direction.

6. The electrical connector plug as claimed in claim 4, wherein the second plug contacts received in one L-shaped tongue configure with a pair of differential signal.

7. The electrical connector plug as claimed in claim 4, wherein the second terminal portions of the second plug contacts received in one L-shaped tongue are in the same plane.

8. The electrical connector plug as claimed in claim 1, wherein the second plug contacts are formed by stamping.

9. An electrical connector receptacle, comprising a receptacle housing defining a pair of L-shaped openings, each L-shaped opening comprising a main opening and a side opening perpendicular with the main opening;

a plurality of first receptacle contacts secured in the receptacle housing and defining a first contacting portion protruding out of a first face of the main opening, a first terminal portion and a first retaining portion bridging the first contacting portion and the first terminal portion; wherein the electrical connector receptacle further comprises at least a pair of second receptacle contacts fixed to an inner face of the side opening away from the main opening and perpendicular to the first face of the main opening.

10. The electrical connector receptacle as claimed in claim 9, wherein the two L-shaped openings are separated with a partition wall, the second receptacle contacts are located at a side face of the partition wall.

11. The electrical connector receptacle as claimed in claim 9, wherein each second receptacle contact defines a second contacting portion of board shaped and a second terminal portion extending from the second contacting portion.

12. The electrical connector receptacle as claimed in claim 11, wherein two second receptacle contacts in one L-shaped opening are in the same plane and have different shapes.

13. An electrical connector assembly comprising:

a first connector including:

a first insulative housing defining an elongated L-shaped mating tongue having a horizontal main board and a vertical side board extending at one end of the main board;

a plurality of first horizontal contacts disposed in the first housing with the first horizontal contacting sections exposed upon the horizontal main board and essentially laterally hidden behind the vertical side board;

at least one first vertical contact disposed in the first housing with a first vertical contacting section exposed upon an exterior face of the vertical side board and essentially segregated from the first horizontal contacting sections via said vertical side board;

a second connector including:

a second insulative housing defining an elongated L-shaped mating slot for receiving said L-shaped mating tongue;

a plurality of second horizontal contacts disposed in the second housing with second horizontal contacting sections exposed on a horizontal inner surface of the second housing in said mating slot;

at least a second vertical contact disposed in the second housing with a second vertical contacting section exposed on a vertical inner surface of the second housing in said mating slot and essentially laterally communicatively facing the second horizontal contacting sections of the second horizontal contacts; wherein when mated, the L-shaped mating tongue of the first connector is received in the L-shaped mating slot under condition that the first horizontal contacting sections of the first horizontal contacts mechanically and electrically connect to the corresponding second horizontal contacting sections of the second horizontal contacts in a vertical direction, and the first vertical contacting section of the first vertical contact mechanically and electrically connect to the corresponding second vertical contacting section of the second vertical contact in a horizontal direction perpendicular to said vertical direction; wherein the first horizontal contacts are configured not to be deflectable during mating while the first vertical contact is configured to be deflectable during mating; the second horizontal contacts are configured to be deflectable during mating while the second vertical contact is configured not to be deflectable during mating.

14. The electrical connector assembly as claimed in claim 13, wherein the first horizontal contacting sections are stiff while the first vertical contacting section is resilient; the second horizontal contacting sections are resilient while the second vertical contacting section is stiff.

15. The electrical connector assembly as claimed in claim 13, wherein said first connector further includes another L-shaped mating tongue with the corresponding horizontal main board the side board and the associated first horizontal contacts and vertical contacts thereon, under condition that the vertical side boards of the two L-shaped mating tongues closely confront each other so that the first vertical contacting sections of the first vertical contacts respectively on the corresponding exterior faces of the vertical side boards of the two L-shaped mating tongues laterally communicatively confront each other with only one gap therebetween.

16. The electrical connector assembly as claimed in claim 15, wherein said second connector further includes another L-shaped mating slot with the corresponding second horizontal contacts and vertical contact thereon, under condition that said two L-shaped mating slots are segregated from each other via a partition wall therebetween, and the second vertical contacting sections of the second vertical contacts respectively in the corresponding L-shaped mating slot are segregated from each other by said partition wall in a back-to-back manner.

17. The electrical connector assembly as claimed in claim 15, during mating the two L-shaped mating tongues are respectively received in the two corresponding L-shaped mating slots.

18. The electrical connector assembly as claimed in claim 15, wherein the first vertical contact disposed in the first housing have different shapes from each other.

19. The electrical connector assembly as claimed in claim 18, wherein the second vertical contact disposed in the second housing have different shapes from each other.

* * * * *